US008502629B2

(12) United States Patent
Dumoux

(10) Patent No.: US 8,502,629 B2
(45) Date of Patent: Aug. 6, 2013

(54) ELECTROMAGNETIC CONTACTOR WITH GUIDE RING

(75) Inventor: Jacques Dumoux, Genas (FR)

(73) Assignee: ABB France (FR)

( * ) Notice: Subject to any disclaimer, the term of this patent is extended or adjusted under 35 U.S.C. 154(b) by 0 days.

(21) Appl. No.: 13/151,518

(22) Filed: Jun. 2, 2011

(65) Prior Publication Data

US 2011/0304414 A1 Dec. 15, 2011

(30) Foreign Application Priority Data

Jun. 11, 2010 (FR) ..... 10 54635

(51) Int. Cl.
*H01F 3/00* (2006.01)
*H01F 7/08* (2006.01)

(52) U.S. Cl.
USPC ..... 335/255; 335/262; 335/270; 335/274; 335/278

(58) Field of Classification Search
USPC ..... 335/262, 270, 274, 255, 278
See application file for complete search history.

(56) References Cited

U.S. PATENT DOCUMENTS

| | | | | |
|---|---|---|---|---|
| 5,544,857 | A * | 8/1996 | Torrence | 251/129.15 |
| 6,292,077 | B1 * | 9/2001 | Kaizuka et al. | 335/281 |
| 6,918,571 | B1 * | 7/2005 | Rose | 251/129.18 |
| 2002/0104977 | A1 * | 8/2002 | Bircann et al. | 251/129.15 |

* cited by examiner

*Primary Examiner* — Ramon Barrera
(74) *Attorney, Agent, or Firm* — Cantor Colburn LLP

(57) ABSTRACT

The present invention relates to an electromagnetic contactor including a stationary armature which includes a housing enclosure for a coil for generating a magnetic field, the enclosure having an opening, a closing cover for the opening of the enclosure, the closing cover having an aperture, and a movable armature passing through the aperture of the closing cover for the opening of the enclosure, further including a guide ring made from non-magnetic material which is arranged in the aperture of the closing cover so as to have, between a first wall in contact with the wall of the aperture of the cover and a second wall facing towards the movable armature, a thickness corresponding to the minimal radial gap between the movable armature and the stationary armature.

4 Claims, 3 Drawing Sheets

ELECTROMAGNETIC CONTACTOR WITH GUIDE RING

TECHNICAL FIELD

The present invention relates to an electromagnetic contactor.

BACKGROUND

As is known, an electromagnetic contactor comprises:

a stationary armature which includes:

- a housing enclosure for a coil for generating a magnetic field, the enclosure having an opening,
- a closing cover for the opening of the enclosure, the closing cover having an aperture, and a movable armature which can move in the aperture of the closing cover for the opening of the enclosure.

The coil generates a magnetic field which is applied to the movable armature when an electric current runs through it.

An elastic means, such as a spring, is provided for keeping the stationary and movable parts apart in the absence of any power supply to the coil.

In general, the electrical operation of a contactor can be described in two separate phases.

During a first, inrush phase, when the coil is supplied with current, the magnetic circuit tends to close, the movable armature approaching the stationary armature until these two parts are in contact. During this phase, a considerable amount of power is required so as to overcome the initial gap and to displace the movable armature counter to the action of the elastic means. This power, referred to as the inrush power, is linked to the number of Ampere-turns of the coil, that is to say the number of turns of the coil multiplied by the intensity of the current in the coil.

During a second, hold phase, the magnetic circuit must remain in the closed position for as long as the coil is supplied with power. In this second phase, the Ampere-turns needed is much lower than in the inrush phase, since the gap is zero due to the position of the movable armature inside the coil, and the magnetic forces are at a maximum.

However, the inrush power required in order to pass from the first to the second phase also depends on the mechanical friction generated by the movement of the movable armature on the separating wall between the movable armature and the stationary armature, this depending on the transverse magnetic effects due to the misalignment of the axis of the movable armature relative to the axis of the stationary armature and to the weight of the movable armature.

It is therefore necessary to control precisely the position of the movable armature in the transverse direction so as to limit the dissymmetries and thus to limit the radial electromagnetic forces while at the same time limiting as far as possible the radial gap so as to maximise the magnetic flux generated by the coil in the movable armature.

BRIEF SUMMARY

The invention solves all or part of the disadvantages mentioned above.

To this end, the present invention relates to an electromagnetic contactor comprising a stationary armature which includes a housing enclosure for a coil for generating a magnetic field, the enclosure having an opening, a closing cover for the opening of the enclosure, the closing cover having an aperture, and a movable armature passing through the aperture of the closing cover for the opening of the enclosure, characterised in that it comprises a guide ring made from non-magnetic material which is arranged in the aperture of the closing cover so as to have, between a first wall in contact with the wall of the aperture of the cover and a second wall facing towards the movable armature, a thickness corresponding to the minimal radial gap between the movable armature and the stationary armature, and in that the closing cover comprises a collar delimiting the aperture and extending towards the interior of the housing enclosure for the coil.

This arrangement enables the non-magnetic ring to perform by itself the function of guiding the movable armature, localising the mechanical friction generated between the movable armature and the stationary armature during the movement of the movable armature only to a guide surface located on the inner surface of the non-magnetic ring, and to give support to the guide ring in the direction of movement of the movable armature.

Moreover, the fact that the ring is arranged at the minimal radial gap between the movable armature and the stationary armature increases the magnetic force generated by the coil on the movable armature and avoids unnecessarily increasing the power supplied to the coil.

According to one embodiment, the guide ring covers the entire collar of the closing cover.

Advantageously, the guide ring comprises a first tubular portion, the thickness of which corresponds to the minimal radial gap between the movable armature and the stationary armature, that is to say that the external diameter of this first tubular portion corresponds substantially to the diameter of the aperture of the cover and that the internal diameter of this first tubular portion corresponds substantially to the diameter of the movable armature in the region of the aperture of the cover.

This arrangement makes it possible to reduce as far as possible the thickness of the gap cutting the magnetic circuit between the stationary armature and the movable armature.

According to the same embodiment, the guide ring comprises a second tubular portion, the internal diameter of which is the same as the internal diameter of the first portion and the external diameter of which is greater than the external diameter of the first portion.

This arrangement makes it possible to ensure the mechanical holding of the guide ring.

According to one embodiment, the second tubular portion is located inside the housing enclosure for the coil.

This arrangement also makes it possible to ensure the mechanical holding of the guide ring inside the housing enclosure for the coil during the repeated movements of the movable armature.

According to one embodiment, the or another second tubular portion is located outside the housing enclosure for the coil.

This arrangement makes it possible to insert the ring once the enclosure is closed by the cover.

According to one embodiment, the first tubular portion protrudes from the aperture of the cover.

This arrangement makes it possible to ensure better guidance of the movable armature.

According to one embodiment, the guide ring is slotted over its height.

This arrangement confers elasticity on the guide ring, contributing to the mechanical holding thereof inside the housing enclosure for the coil.

According to one embodiment, the guide ring comprises a housing for one end of a return means for returning the movable armature.

This arrangement makes it possible to exert a continuous pressure counter to the guide ring.

BRIEF DESCRIPTION OF THE DRAWINGS

In any event, the invention will be clearly understood with the aid of the following description and with reference to the appended schematic drawing which shows, by way of non-limiting example, an electromagnetic contactor according to the invention.

DETAILED DESCRIPTION

Figure 1:
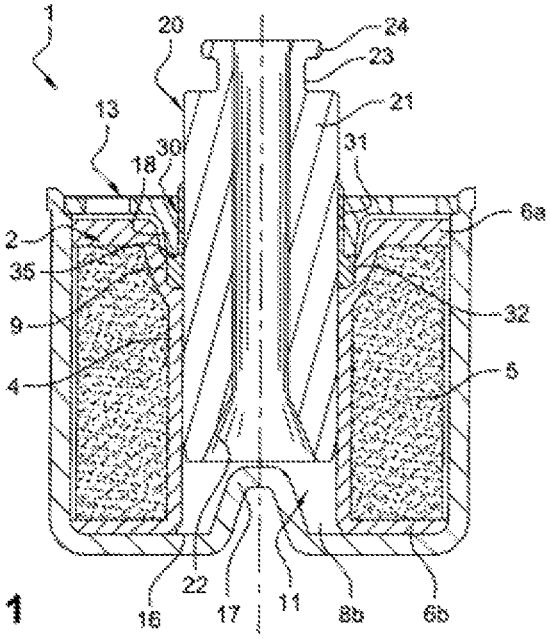
FIG. 1 shows a partial view in cross section of an electromagnetic contactor according to a first embodiment of the invention.
Figure 2:
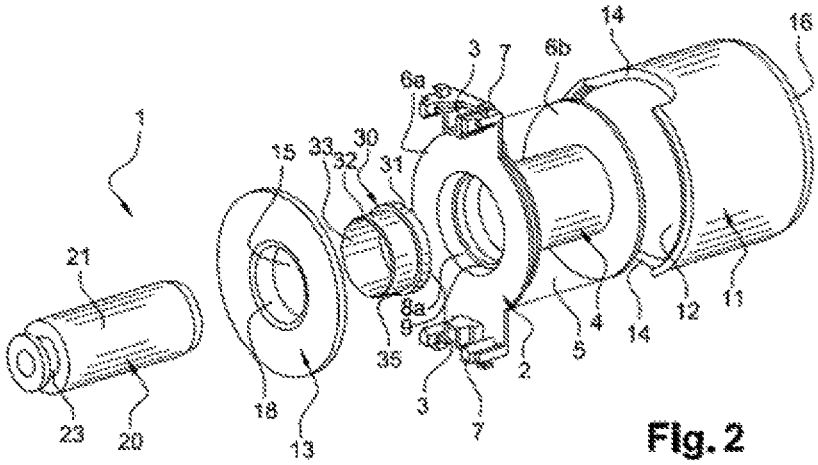
FIG. 2 shows a partial exploded perspective view of the electromagnetic contactor of FIG. 1.

As shown in FIGS. 1 and 2, an electromagnetic contactor 1 comprises a stationary armature 10 and a movable armature 20, also called the core.

The stationary armature 10 comprises a housing enclosure 11, also called the magnetic tank, which is intended to accommodate a coil 2 for generating a magnetic field when an electric current passes therethrough.

The coil 2 is formed by the winding of a conductor 5 around a hollow body 4 of cylindrical shape.

The hollow body 4 forms the join between a first base 6*a* and a second base 6*b*, both of these having the shape of a disc arranged transversely on one end of the cylindrical hollow body 4.

The bases 6*a*, 6*b* each respectively comprise an opening 8*a*, 8*b* which opens into the interior of the cylindrical hollow body 4.

The opening 8*a* comprises a portion having a diameter greater than the internal diameter of the cylindrical hollow body 4. The difference between the diameter of this portion and the cylindrical hollow body 4 is compensated by an annular shoulder 9 arranged in the opening 8*a*.

The base 6*a* comprises two portions 7 which are located opposite one another and which are intended to accommodate the connection terminals 3 of the conductor 5 of the coil 2.

These two portions 7 protrude from the surface of the contour of the cylindrical shape produced by the winding of the conductor 5 around the cylindrical hollow body 4.

The housing enclosure 11 for its part has a cylindrical shape with, on the one hand, a main opening 12 for the insertion of the coil 2 in the region of a first base of this cylindrical shape with two other secondary openings 14 arranged on the surface of the contour of the cylindrical shape of the housing chamber 11 and located opposite one another and contiguous with the main opening 12, and on the other hand a bottom 16 have a portion 17 in the shape of an inverted "V" protruding into the housing enclosure 11.

The two secondary openings 14 define the location of the two portions 7 of the base 6*a* protruding from the surface of the contour of the cylindrical shape produced by the winding of the conductor 5 and comprising the terminals 3 of the coil 2 when the latter is in place in its housing enclosure 11.

The main opening 12 is covered by a closing cover 13 which confines the coil 2 in its housing enclosure 11. This closing cover 13 comprises an aperture 15 having a collar 18 oriented transversely to the surface of the closing cover 13 towards the inside of the housing enclosure 11.

The internal diameter of this collar 18 is substantially the same as the diameter of the interior of the cylindrical hollow body 4 and the external diameter of this collar 18 is substantially the same as the diameter of the larger-diameter portion of the opening 8*a* of the base 6*a* of the coil 2.

The movable armature 20 is made in one piece and is formed by a hollow body 21 of cylindrical shape having a diameter substantially equal to that of the interior of the cylindrical hollow body 4 of the coil 2.

This cylindrical hollow body 21 comprises a lower portion including a recess 22 which has a shape complementary to the inverted "V"-shaped portion 17 arranged at the bottom 16 of the housing enclosure 11 and protruding into the housing chamber 11.

The cylindrical hollow body 21 also comprises a head 23 having a diameter smaller than the main diameter of the cylindrical hollow body 21, with a shoulder 24 at the end of the head 23 having a diameter intermediate between the main diameter of the head 23 and the main diameter of the cylindrical hollow body 21.

The head 23 is intended to immobilise a contact carrier (not shown), the lower face of which is used as a support for a first end 41 of a helical return spring 40 which has the function of keeping the stationary armature 10 and the movable armature 20 apart in the absence of any power supply to the coil 2, the second end 42 of the helical return spring 40 bearing against the closing cover 13.

Figure 3:
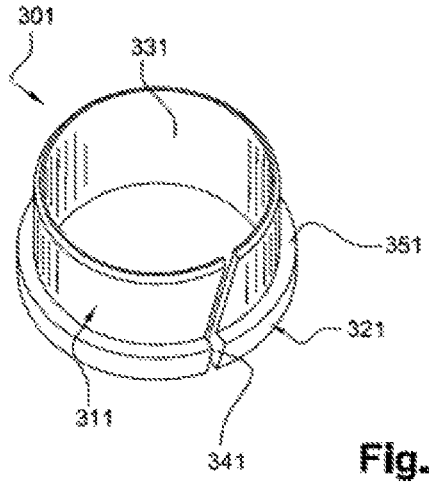
FIG. 3 shows a detailed perspective view of a guide ring alone which is used in the first embodiment of an electromagnetic contactor.

As shown in FIGS. 1 and 2, in a first embodiment, an annular ring 301 (shown more particularly in FIG. 3) is inserted between the coil 2 and the closing cover 13.

This ring 301 is made from a non-magnetic material, that is to say a material devoid of any magnetic properties, such as for example a thermoplastic material.

The ring 301 comprises a first portion 311 and a second portion 321 forming an annular shoulder 351.

The external diameter of the first portion 311 is smaller than the external diameter of the second portion 321.

This external diameter of the second portion 321 corresponds substantially to the diameter of the annular shoulder 9 arranged in the opening 8*a* of the base 6*a* of the coil 2, while the external diameter of the first portion 311 corresponds substantially to the diameter of the aperture 15 of the closing cover 13.

The internal diameter of the first portion 311 and the internal diameter of the second portion 321 are both substantially equal to the external diameter of the cylindrical hollow body 21 of the movable armature 20, thus forming a guide surface 331 for the latter.

The guide ring 301 is slotted and comprises an oblique slot 341 along its entire height.

This slot 341 confers radial elasticity on the ring 301, enabling it to be inserted and to be held more easily on the one hand on the annular shoulder 9 arranged in the opening 8*a* of the base 6*a* of the coil 2 and on the other hand against the collar 18 of the closing cover 13.

The first portion 311 passes entirely through the aperture 15 of the closing cover 13, protruding therefrom, the second portion 322 serving as a stop for the pushing of this first portion 311 into the aperture 15 of the closing cover 13.

The guide ring 301 is arranged coaxially to the cylindrical hollow body 21 of the movable armature 20 and is held in this position by the end of the collar 18 of the aperture 15 of the closing cover 13 which, in its normal closed position, bears against the shoulder 351 of the guide ring 301 so as to press it against the shoulder 9 arranged in the opening 8*a* of the base 6*a* of the coil 2.

Figure 4:
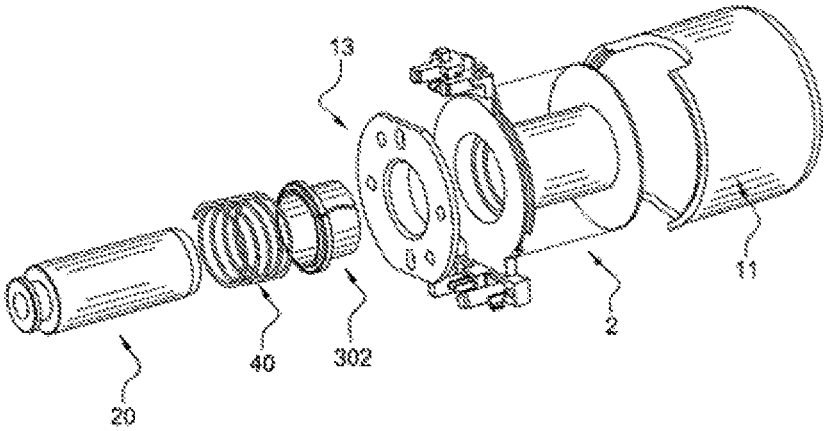
FIG. 4 shows an exploded perspective view of an electromagnetic contactor according to a second embodiment of the invention.
Figure 5:
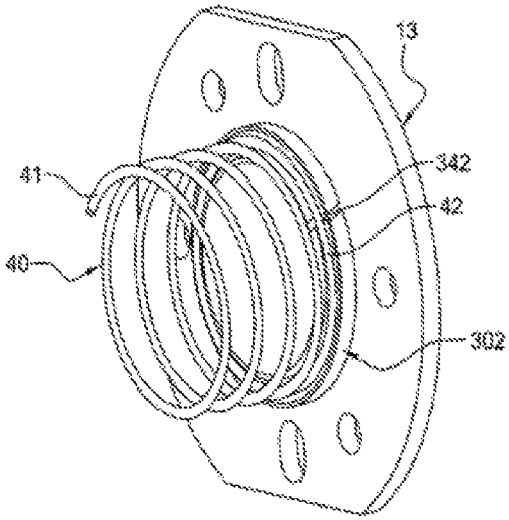
FIG. 5 shows a detailed perspective view of part of the electromagnetic contactor of FIG. 4.
Figure 6:
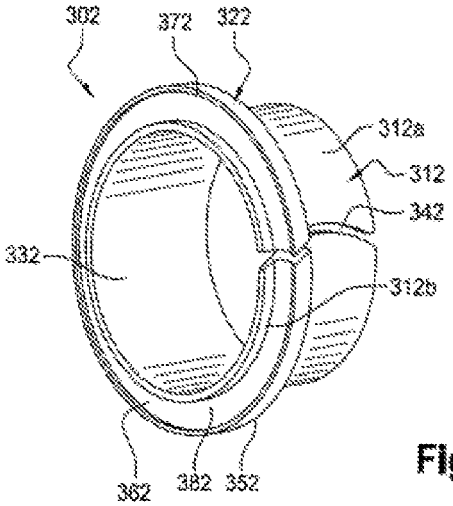
FIG. 6 shows a detailed perspective view of a guide ring alone which is used in the second embodiment of an electromagnetic contactor.

As shown in FIGS. 4 and 5, in a second embodiment, an annular ring 302 (shown more particularly in FIG. 6) is inserted between the closing cover 13 and the helical return spring 40.

This ring 302 is made from a non-magnetic material, that is to say a material devoid of any magnetic properties, such as for example a thermoplastic material.

The ring 302 comprises a first portion 312 and a second portion 322.

The first portion 312 comprises a first part 312*a* and a second part 312*b* separated by the second portion 322 forming a first annular shoulder 352 and a second annular shoulder 362 respectively between the first part 312*a* of the first portion 312 and the second portion 322 and between the second part 312*b* of the first portion 312 and the second portion 322.

The external diameter of the two parts 312*a*, 312*b* of the first portion 312 is smaller than the external diameter of the second portion 322.

The external diameter of the two parts 312*a*, 312*b* of the first portion 312 corresponds substantially to the diameter of the aperture 15 of the closing cover 13, while the external diameter of the second portion 322 is slightly larger than the diameter of the helical return spring 40 arranged between the contact carrier and the closing cover 13.

The second shoulder 362 comprises a peripheral edge 372, thus delimiting a housing 382 for the second end 42 of the helical return spring 40.

The internal diameter of the first portion 312 and the internal diameter of the second portion 322 are both substantially equal to the external diameter of the cylindrical hollow body 21 of the movable armature 20, thus forming a guide surface 332 for the latter.

The guide ring 302 is slotted and comprises a curved slot 342 along its entire height.

This slot 342 confers radial elasticity on the ring 302, enabling it to be inserted in the aperture 15 of the closing cover 13 and to be held more easily against on the one hand the collar 18 of this same closing cover 13 and on the other hand on the annular shoulder 9 arranged in the opening 8*a* of the base 6*a* of the coil 2, the diameter of which corresponds substantially in this embodiment to the external diameter of the first portion 312 of the ring 302.

The first part 312*a* of the first portion 312 passes entirely through the aperture 15 of the closing cover 13, protruding therefrom, the second portion 322 serving as a stop for the pushing of this first part 312*a* of the first portion 312 into the aperture 15 of the closing cover 13.

The guide ring 302 is arranged coaxially to the cylindrical hollow body 21 of the movable armature 20 and is held in this position by the action of the helical return spring 40 in the housing 382 of the guide ring 302 so as to press it against the closing cover 13.

Thanks to the mechanical arrangement of these different elements, the gap between the stationary armature 10 and the movable armature 20 is minimal and corresponds to the thickness of the first portion 31 of the guide ring 30. In the embodiments shown, this thickness is 0.8 mm.

Thus, when a current that is high enough to trigger the inrush phase is supplied to the coil 2, the cylindrical hollow body 21 of the movable armature 20 will slide inside the housing enclosure 11 until it butts against the bottom 16 of the housing enclosure 11.

During this movement, the lateral walls of the cylindrical hollow body 21 rub against the guide surface 33 of the guide ring 30.

The height of the guide ring 30, the minimised play thereof relative to the cylindrical hollow body 21 and the coefficient of friction of the cylindrical hollow body 21 on the guide surface 33 make it possible to guide in a suitable manner the cylindrical hollow body 21 as far as the bottom of the housing enclosure 11, while reducing the forces, dissymmetries and radial electromagnetic forces.

Once at the bottom 16 of the housing enclosure 11, the recess 22 of the cylindrical hollow body 21 coincides with the protruding portion 17 arranged on the bottom 16 of the housing enclosure 11.

After the current has been reduced below a certain threshold value keeping the cylindrical hollow body 21 of the movable armature 20 inside the housing enclosure 11, the cylindrical hollow body 21 returns to its original position under the action of the helical return spring 40, the guide ring 30 having the sole function of guiding the cylindrical hollow body 21 of the movable armature 20.

Although the invention has been described in connection with one particular example of embodiment, it is obvious that it is in no way limited thereto and that it encompasses all the technical equivalents of the means described as well as combinations thereof. For instance, the electromagnetic contactor 1 could comprise a guide ring comprising a combination of the two embodiments shown, with a first portion located between the closing cover 13 and the housing enclosure 11 and a second portion located between the contact carrier and the closing cover 13. The insertion of such a guide ring through the aperture 15 of the closure cover is made possible by virtue of the elasticity of the ring and its slot, the geometry of which could allow an overlapping of the two edges of the slot as said ring is put in place through the aperture 15.

The invention claimed is:

1. Electromagnetic contactor comprising:

a stationary armature which includes:

a housing enclosure for a coil for generating a magnetic field, the enclosure having an opening, a closing cover for the opening of the enclosure, the closing cover having an aperture, a movable armature passing through the aperture of the closing cover for the opening of the enclosure, and a guide ring made from non-magnetic material which is arranged in the aperture of the closing cover so as to have, between a first wall in contact with the wall of the aperture of the cover and a second wall facing towards the movable armature, a thickness corresponding to the minimal radial gap between the movable armature and the stationary armature, wherein the guide ring comprises a first tubular portion, the thickness of which corresponds to the minimal radial gap between the movable armature and the stationary armature, wherein the external diameter of the first tubular portion corresponds substantially to the diameter of the aperture of the cover and that the internal diameter of this first tubular portion corresponds substantially to the diameter of the movable armature in the region of the aperture of the cover; and a second tubular portion located inside the housing enclosure, the internal diameter of which is the same as the internal diameter of the first portion and the external diameter of which is greater than the external diameter of the first portion, and wherein the closing cover comprises a collar delimiting the aperture and extending towards the interior of the housing enclosure for the coil, wherein the guide ring covers the entire collar.

2. Electromagnetic contactor according to claim 1, wherein the first tubular portion protrudes from the aperture of the cover.

3. Electromagnetic contactor according to claim 1, wherein the guide ring is slotted over its height.

4. Electromagnetic contactor comprising:

a stationary armature which includes:

a housing enclosure for a coil for generating a magnetic field, the enclosure having an opening, a closing cover for the opening of the enclosure, the closing cover having an aperture, a movable armature passing through the aperture of the closing cover for the opening of the enclosure, and a guide ring made from non-magnetic material which is arranged in the aperture of the closing cover so as to have, between a first wall in contact with the wall of the aperture of the cover and a second wall facing towards the movable armature, a thickness corresponding to the minimal radial gap between the movable armature and the stationary armature, wherein the guide ring comprises:

a housing for one end of a return means for returning the movable armature, a first tubular portion, the thickness of which corresponds to the minimal radial gap between the movable armature and the stationary armature, wherein the external diameter of the first tubular portion corresponds substantially to the diameter of the aperture of the cover and that the internal diameter of this first tubular portion corresponds substantially to the diameter of the movable armature in the region of the aperture of the cover; and a second tubular portion located outside the housing enclosure for the coil, the internal diameter of which is the same as the internal diameter of the first portion and the external diameter of which is greater than the external diameter of the first portion, and wherein the closing cover further comprises a collar delimiting the aperture and extending towards the interior of the housing enclosure for the coil, wherein the guide ring covers the entire collar.

* * * * *